United States Patent [19]

Lawson

[11] Patent Number: 4,819,832

[45] Date of Patent: Apr. 11, 1989

[54] PUMP TYPE DISPENSER WITH SWIVELLABLE NOZZLE FOR LOCKING THE PUMP

[75] Inventor: Thomas J. Lawson, Leicester, England

[73] Assignee: The English Glass Company Limited, United Kingdom

[21] Appl. No.: 85,209

[22] Filed: Aug. 14, 1987

[30] Foreign Application Priority Data

Aug. 18, 1986 [GB] United Kingdom ..... 8620072

[51] Int. Cl.[4] ..... B67D 5/32

[52] U.S. Cl. ..... 222/153; 222/183; 222/531; 222/534

[58] Field of Search ..... 222/131, 153, 182–183, 222/402.11, 402.13, 533–536, 538, 556, 372, 382, 383, 385, 531

[56] References Cited

U.S. PATENT DOCUMENTS

| | | | |
|---|---|---|---|
| 3,116,856 | 1/1964 | Prussin et al. | 222/536 X |
| 3,148,806 | 1/1964 | Meshberg | 222/394 |
| 3,221,950 | 12/1965 | O'Donnell | 222/402.13 X |
| 3,622,053 | 11/1971 | Ryden | 222/402.11 |
| 3,884,392 | 5/1975 | Hazard | 222/153 |
| 3,934,761 | 1/1976 | Gentreau | 222/183 |
| 4,424,920 | 1/1984 | Tada | 222/402.11 |
| 4,620,646 | 11/1986 | Crapser | 222/153 |

FOREIGN PATENT DOCUMENTS

| | | |
|---|---|---|
| 2513352 | 12/1977 | Fed. Rep. of Germany . |
| 81/00995 | 4/1981 | PCT Int'l Appl. . |
| 1152490 | 5/1969 | United Kingdom . |

*Primary Examiner*—Michael S. Huppert

*Attorney, Agent, or Firm*—Stevens, Davis, Miller & Mosher

[57] ABSTRACT

A dispenser is specially adapted for being carried in handbags or pockets. A nozzle is pivotable between a projecting and a retracted position. When in the retracted position it lies within the envelope of a casing and a pump head on which it is mounted is blocked from any movement by abutment against a part on the casing, this part also acting to block the outlet end of a passage in the nozzle to prevent leakage of any material left in that passage after the last use of the dispenser. At the same time the inlet to the passage is closed off by a wall of the passage. When the nozzle is in its projecting position, the inlet and the passage are put in communication and the head may be depressed to express a charge through the nozzle.

10 Claims, 3 Drawing Sheets

Fig.1.
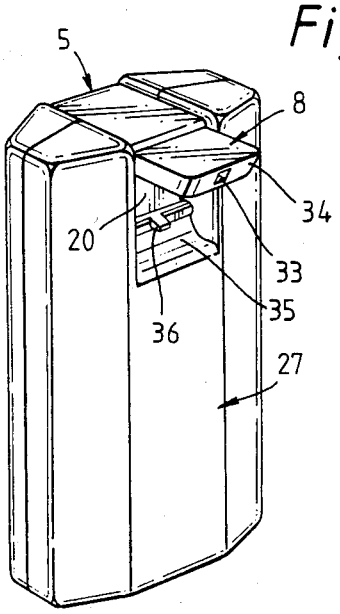
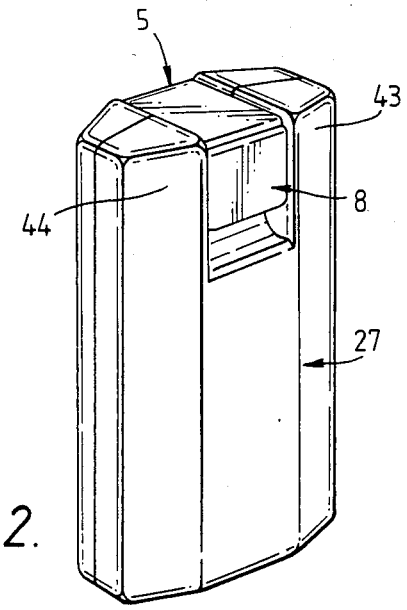
Fig.2.
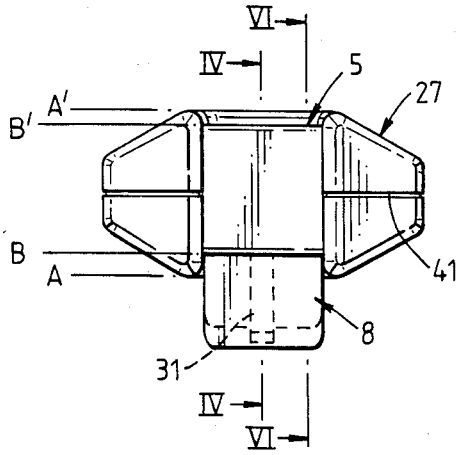
Fig.3.

PUMP TYPE DISPENSER WITH SWIVELLABLE NOZZLE FOR LOCKING THE PUMP

This invention relates to dispensers and is concerned to provide a compact pump dispenser for liquids, creams and pastes especially suited to the needs of travellers.

Most pump dispensers are unsuitable for travellers' use. They tend to have projecting nozzles or other parts which make them unhandy for suitcases, handbags or pockets. They tend also to require special precautions to be taken to prevent leakage if they are inverted or subjected to changes of pressure or temperature.

In the prior art, GB-A-1152490 shows a dispenser where the discharge nozzle is extensible and retractible in straight-line movements. When in the retracted condition it hardly projects beyond the outline of the casing and also it interacts with the casing to prevent depression of the pump actuating button; when in the extended position it projects out from the casing and frees the pump actuating button to allow it to be depressed. U.S. Pat. No. 3,148,806 shows a swivellable nozzle at the side of a cap of an aerosol container. When the nozzle lies down alongside the container, a block associated with it interacts with the container to prevent depression of the aerosol cap, but when the nozzle is swivelled to project away from the container no such interaction occurs and the cap may be depressed.

The object of the present invention is to provide a pump dispenser of especially compact and secure construction.

We achieve this by arranging that in an inoperative condition the whole of the pump including its nozzle may be contained within the envelope of an outer casing, without or substantially without projection; but that the nozzle may be pivoted to an operative position by the user. While in the inoperative position the pump is locked to prevent movement, and this locking is most efficiently achieved by the pivoting nozzle in that condition acting to abut against a stationary part, which does not however interfere with it when it is in its operative position.

Furthermore, that abutment will preferably also act to block the outlet of the nozzle.

Also, the pivoting of the nozzle between its inoperative and operative positions will preferably serve to close and open a communication path between the through-passage of the nozzle and the output of the pump.

A particular embodiment of the invention will now be described with reference to the accompanying drawings, wherein:

FIGS. 1 and 2 are perspective views of the dispenser in operative and inoperative condition respectively;

FIG. 3 is a plan view;

Figure 5:
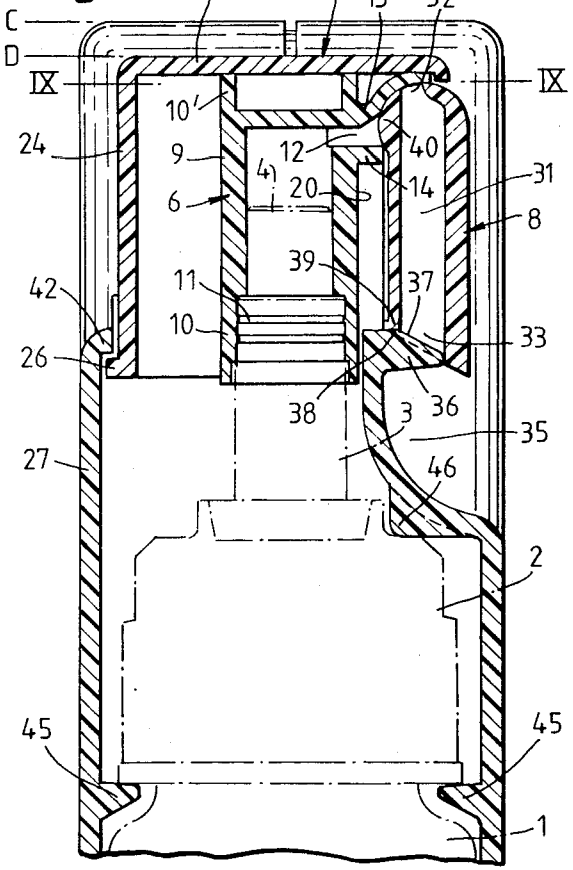
FIGS. 4 and 5 are sections both on the plane IV—IV, of FIG. 3, showing the nozzle in depressed and inoperative conditions respectively.

The dispenser shown is intended to be carried in a pocket or handbag. It may be used to dispense suitable liquid, cream or paste; scents, eaux de toilette, creams, soaps, etc.

The liquid charge is contained in a bottle 1, preferably of non-breakable plastics, to the mouth of which is fitted by means of a collar 2, a dispenser pump body 3 the pump action of which is entirely conventional. Single or double valving in the body assures the discharge from the outlet 4 of the pump of a repeated volume of the contents of the bottle 1, every time the body is caused to reciprocate through an axial stroke, return being associated by a spring in the body.

Onto the outlet 4 is fitted an operating head 5 of the dispenser. This head has three parts: a chassis 6, a shroud 7 and a nozzle 8.

The chassis 6 has a central cylinder 9, a lower end 10 of which is to fit, with snap-fitting 11, onto the body 3 and outlet 4 of the pump. An upper end 10' of the cylinder is to support a top wall 25 of the shroud.

At one side of the cylinder 9, a radial duct 12 opens and extends outwardly between upper wall 13 and lower wall 14, the upper wall 13 further extending in a part-cylinder.

At each lateral side of the walls 13, 14 ridges 15, 16 (FIGS. 6, 7, 9) project upwardly and bear axle-forming cylinders 17 which may be relieved centrally at 18.

Figure 9:
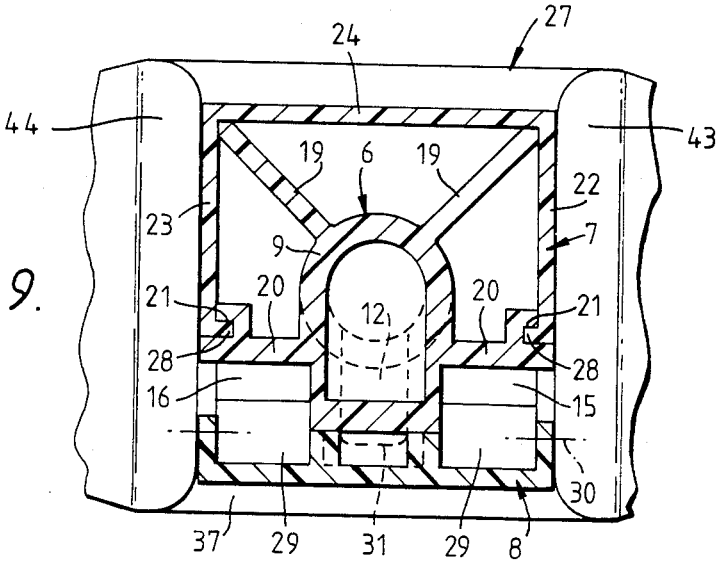
FIG. 9 is a sectional view on the line IX—IX, FIG. 5.

As seen in FIG. 9, walls 19 diverge from the cylinder 9; front walls 20 bear at each end slideways 21.

The ends of the walls 19 and slideways 21 are for positioning the shroud 7, which has side walls 22, 23, rear wall 24 and top wall 25. The rear and top walls have rectangular exposed faces. Along the base of the rear wall 24, a rib 26 is to engage with an outer casing 27 of the dispenser as will be described. Engagement of inturned end flanges 28 of the shroud 7 in the slideways 21 of the chassis insures stability of the shroud 7 on the chassis 6 of the head 5.

The nozzle 8 is of substantially the full width of the head 5 as a whole and has a rectangular, flat, front, face. At each lateral side arcuate C's 29 extend over about 270° and are to clip by distortion over the axle-forming cylinders 17 to allow the nozzle to swivel between the positions seen in FIGS. 4 and 5 about the transverse axis 30 through about 90°; the limit of this travel being determined by abutment of the ends of the C's 29 on the ridges 15, 16 (see FIGS. 6 and 7).

A tubular duct 31 of rectangular cross-section starts at a port 32 in the central part of the nozzle adjacent to the chassis 6, in register with the port 12, and emerges as a port 33 in an undercut front wall 34 of the nozzle.

In the inoperative condition of the dispenser, the position of the nozzle 8 is as shown in FIGS. 2 and 5.

In the front of the casing 27 of the dispenser is a recess 35 allowing access for the finger of a user for lifting the nozzle 8 towards the operative position. A projection 36 is of a size to fit snugly into port 33. An inclined front wall 37 of the projection 36 is followed by a horizontal portion 38. Engagement between this and the end 39 of a lower wall of the duct 31 gives a positive indication to the user that the dispenser is inoperative.

In that condition, the port 32 is closed by the wall 13; the duct 12 is closed by a cylindrical hub part 40 of the nozzle.

Also, the projection 36 has two effects: it obstructs the outlet port 33 to prevent leakage of any liquid residue that might have been in the through-passage and it prevents, by abutment onto the wall 39 of the through-passage, any downward movement of the dispenser head and hence of the pump body.

Figure 4:
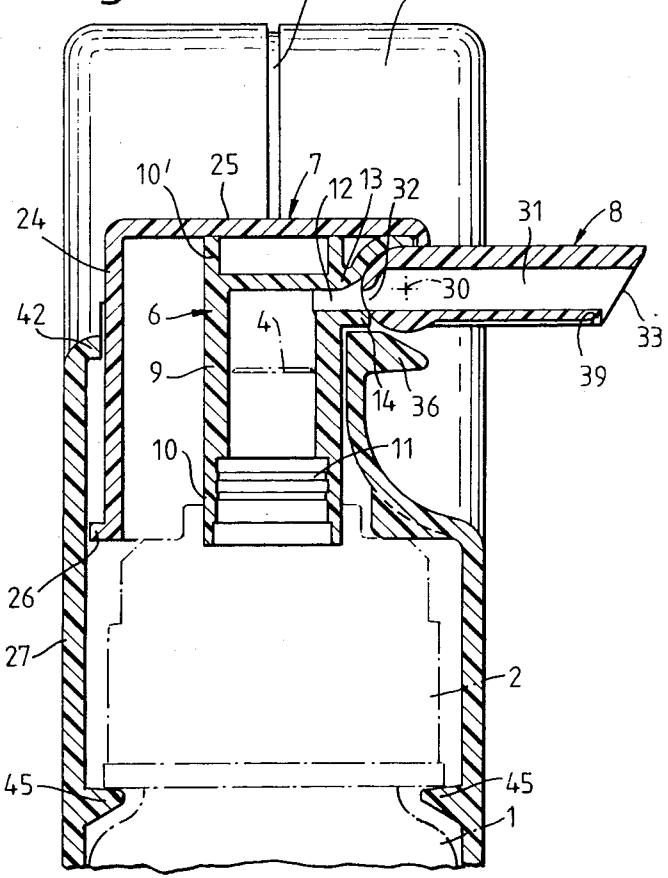
Figure 6:
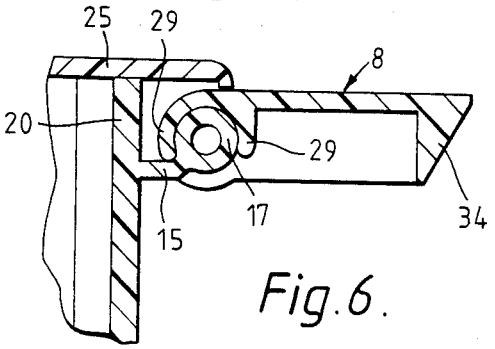
FIGS. 6 and 7 are partial sections both on the plane VI—VI, of FIG. 3, showing the nozzle in operative and inoperative conditions respectively.
Figure 7:
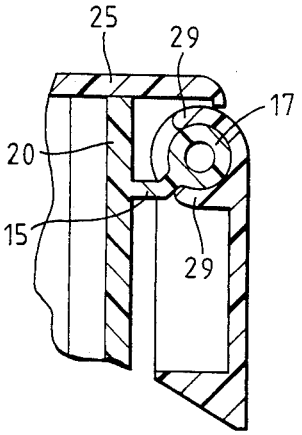
Figure 8:
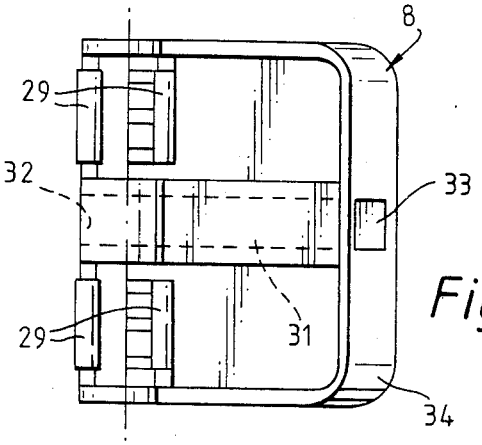
FIG. 8 is an underneath plan view of a nozzle part.

In the operative condition, the position of the nozzle is as seen in FIGS. 1, 4 and 6. It exposes the recess 35 and the rectangular, flat, front face of wall 20. Port 32 and duct 12 are in register hence ducts 12 and 31 are in communication. Nothing obstructs reciprocal movement of the pump under the influence of axial pressure exerted by the user on the head 5.

The outer casing 27 is formed of two halves which are conventionally irreversibly snap-fitted together along plane 41. This is done after assembly together of the head 5 onto the pump, so that an inturned edge 42 of the rear half will entrap the rib 26 of the shroud 7 to prevent its escape. Internally, ledges 45, 46 assist support and location of the bottle 1 and collar 2.

Clearly, the external shape and dimensions of the casing 27 are not critical. The top wall 25 of the shroud 7 may be ridged and/or recessed to aid security of operation.

However, it is preferred that in the inoperative condition of the dispenser, no part of the dispenser head projects beyond the envelope of the outer casing 27. The casing 27 has two upstanding wings 43, 44 lying on respective lateral sides of the head 5. The forwardmost plane A and the rearwardmost plane A′ joining these wings are seen in FIG. 3. The forwardmost B and rearwardmost B′ planes of the head 5 (in its inoperative condition) do not project beyond and indeed are inset from the planes A,A′. Similarly, the topmost plane C (FIG. 5) common to the wings 43, 44 lies upwardly beyond, or at least level with, the upmost plane D of the head 5.

As far as possible all parts should be of plastic material for lightness and shatter resistance.

It can be seen that when this dispenser is inoperative it is entirely contained within the outline (envelope) of the outer casing; it is locked against accidental depression with both the pump and nozzle outlets being blocked. However it is easily made ready for use by a simple pivoting of the nozzle about an axis perpendicular to the direction of stroke of the pump, this pivoting at the same time freeing the various passages and bringing the outlet of the nozzle to an accessible and projecting position.

I claim:

1. A pump dispenser for discharging fluid from a container comprising:

a casing having wings, a pump head, means for mounting the pump head in the casing between the wings, one wing on each lateral side thereof, for movement of the head relative to the casing in straight-line pumping movements, a nozzle swivellably mounted on a front face of the pump head, the nozzle being swivellable to and between first and second limit positions about an axis generally perpendicular to the direction of said straight-line pumping movement, the nozzle in the first said limit position engaging, by its end remote from the swivellable mounting, an abutment of the casing whereby to prevent said pumping movement of the head relative to the casing, a duct in the nozzle, a duct in the head, means cutting off fluid communication between the said ducts when the nozzle is in its first said limit position, the nozzle projecting outwardly from a lateral plane joining the fronts of the wings, in the second limit position the nozzle being free of said abutment and said ducts being in fluid communication with each other whereby the head may undergo said pumping movement relative to the casing and fluid may be dispensed in response to said pumping movement via the ducts in the head and the nozzle.

2. A dispenser as claimed in claim 1 wherein said abutment comprises means adapted to obstruct the duct in the nozzle when the latter is in said first limit position.

3. A dispenser according to claim 1 wherein the casing includes a body and two wing portions, the wing portions being upstanding respectively on opposite lateral sides of the head and a recess between the wing portions completely accommodating the head and the nozzle when in its said first position.

4. A dispenser according to claim 3 wherein the recess includes an inwardly and upwardly curved portion below the end of the nozzle when in its said first position to offer access for a finger of a user to an end face of the nozzle whereby to swivel the nozzle towards its said second position.

5. A dispenser according to claim 3 wherein the nozzle is a flap with a major substantially flat rectangular face lying parallel to the lateral direction of the dispenser and not projecting forwardly, in said first position, from said lateral plane joining the forwardmost projecting portions of the wings.

6. A dispenser according to claim 5 wherein said nozzle extends through the said lateral plane when in its said second position.

7. A dispenser according to claim 5 wherein a rear face of the head is a substantially flat rectangular face parallel to the substantially flat face of the nozzle when in its said first position and not projecting rearwardly beyond the plane joining the rearwardmost projecting portions of the wings.

8. A dispenser according to claim 5, wherein the head has a top which is a substantially rectangular face which does not project upwardly beyond the plane joining the uppermost projecting portions of the wings.

9. A dispenser according to claim 5, wherein a portion of the front face of the head, underlying the nozzle, is a substantially flat rectangular face lying parallel to the substantially flat rectangular face of the nozzle when the latter is in its said first position.

10. A dispenser according to claim 5 wherein the closing-off between the ducts is effected by a wall part of the duct in the nozzle being brought to extend across a mouth of the duct in the head by the swivelling of the nozzle to the said first position.

* * * * *